United States Patent [19]

Malagnoux et al.

[11] 4,313,333

[45] Feb. 2, 1982

[54] PLIERS FOR POSITIONING CLIPS FORMING CONNECTING RINGS BETWEEN A WIRE NETTING AND SUPPORT WIRES

[75] Inventors: Roger Malagnoux; Pierre Grehal, both of Val d'Oise, France

[73] Assignee: Societe d'Exploitation des Etablissements Pierre Grehal, Val d'Oise, France

[21] Appl. No.: 116,891

[22] Filed: Jan. 30, 1980

[30] Foreign Application Priority Data

Jan. 30, 1979 [FR] France ..... 79 02301

[51] Int. Cl.[3] ..... B21D 7/06

[52] U.S. Cl. ..... 72/410; 29/243.56; 140/123

[58] Field of Search ..... 72/409, 410, 451; 140/117, 121, 123; 29/268, 243.56

[56] References Cited

U.S. PATENT DOCUMENTS

| | | | |
|---|---|---|---|
| 2,055,257 | 9/1936 | Maynard | 72/410 |
| 2,174,152 | 9/1939 | Curtiss | 72/410 |
| 2,178,391 | 10/1939 | Curtiss | 72/410 |
| 2,194,748 | 3/1940 | Glaser | 72/410 |
| 3,945,238 | 3/1976 | Eckert | 72/410 |
| 4,136,548 | 1/1979 | Dippold | 72/409 |

*Primary Examiner*—Gene P. Crosby
*Attorney, Agent, or Firm*—Becker & Becker, Inc.

[57] ABSTRACT

Pliers for positioning clips which form connecting rings between a wire netting and support wires. The pliers comprise two arms pivotally connected together, with the front ends of these two arms causing displacement of two small rods articulated on a same pin which is rigid with a mobile part guided between two plates which form a body for the pliers and carry at a rear portion the pivot axis of the arms. The plates are spaced apart at the front end by a fixed part of substantially the same thickness as that of the mobile part, and each plate comprises an upper portion with an opening which, in cooperation with a clip supply magazine mounted perpendicularly to the plates, enables introduction of a clip behind the mobile part and deformation of the clip between the mobile part and the fixed part so as to surround the support wire and a wire forming the netting. Displacement of the pin which drives the mobile part is limited by openings provided in the plates which form the pliers body. The plates of the plier body may comprise a recessed conformation opposite the clip supply magazine for facilitating disengagement of the rings formed by the pliers.

7 Claims, 9 Drawing Figures

3

PLIERS FOR POSITIONING CLIPS FORMING CONNECTING RINGS BETWEEN A WIRE NETTING AND SUPPORT WIRES

The present invention relates to pliers which enable a simple and quick positioning, at intervals, of clips which form rings for the connection of a wire netting maintained by support wires stretched between posts in order to make a fence.

The erection of garden or similar fences or the like requires the connection of the wire netting with the support wires when the posts and wires are in place. Quite often this connection is provided by small bits of wire which are manually positioned, one afer the other. This is a time-consuming operation which does not produce a correct tensioning of the wire netting on the wires, because the tightening of the connecting elements is not always constant, and therefore the wire netting slides in relation to the support wires.

It is therefore an object of the present invention to remedy these disadvantages by providing pliers which enable the positioning of ring forming clips. The rings so made are tightened in a uniform and constant manner thereby providing a perfect connection between the wire netting and the wires intended for supporting it.

This object, and other objects and advantages of the present invention will appear more clearly from the following specification in connection with the accompanying drawings, in which.

The pliers of the present invention are characterized primarily by two arms pivotally connected together, with the front ends of the two arms causing displacement of two small rods articulated on the same pin. The pin is rigid, with a mobile part guided between two plates forming a body for the pliers and carrying at a rear portion the pivot axis of the arms. The plates are spaced apart at the front end by a fixed part of substantially the same thickness as that of the mobile part. Each plate comprises an upper portion with an opening which, in cooperation with a clip supply magazine placed perpendicularly to the plates, enables introduction of a clip behind the mobile part and deformation of the clip between said mobile part and the fixed part so as to surround the support wire and a wire forming the netting. Displacement of the pin which drives the mobile part is limited by openings provided in the plates which form the pliers body. One of the plates of the pliers body may comprise a recessed conformation opposite the clip supply magazine for facilitating disengagement of the rings formed by the pliers.

Figure 1:
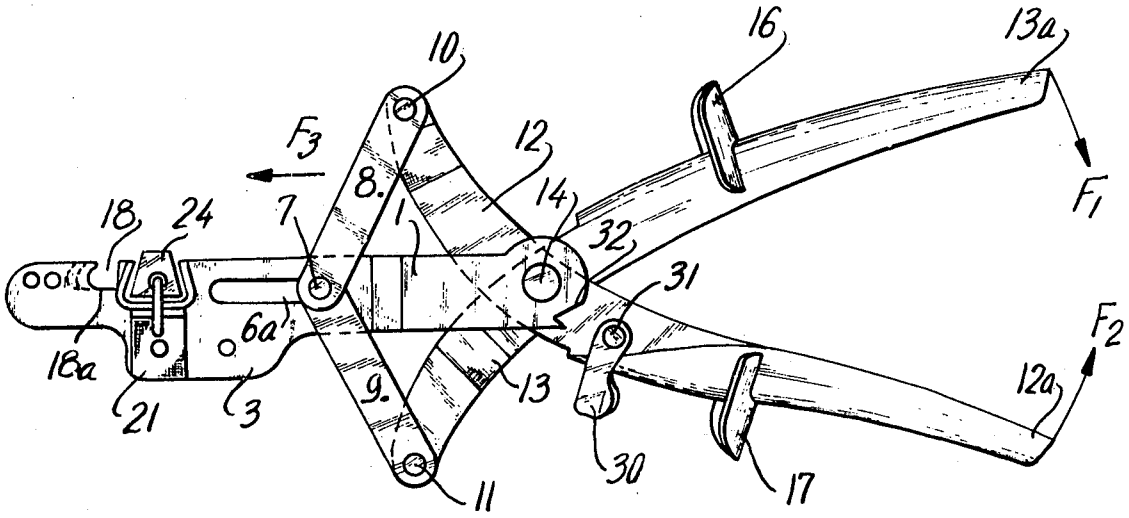
FIG. 1 is a side elevation view of the pliers.
Figure 2:
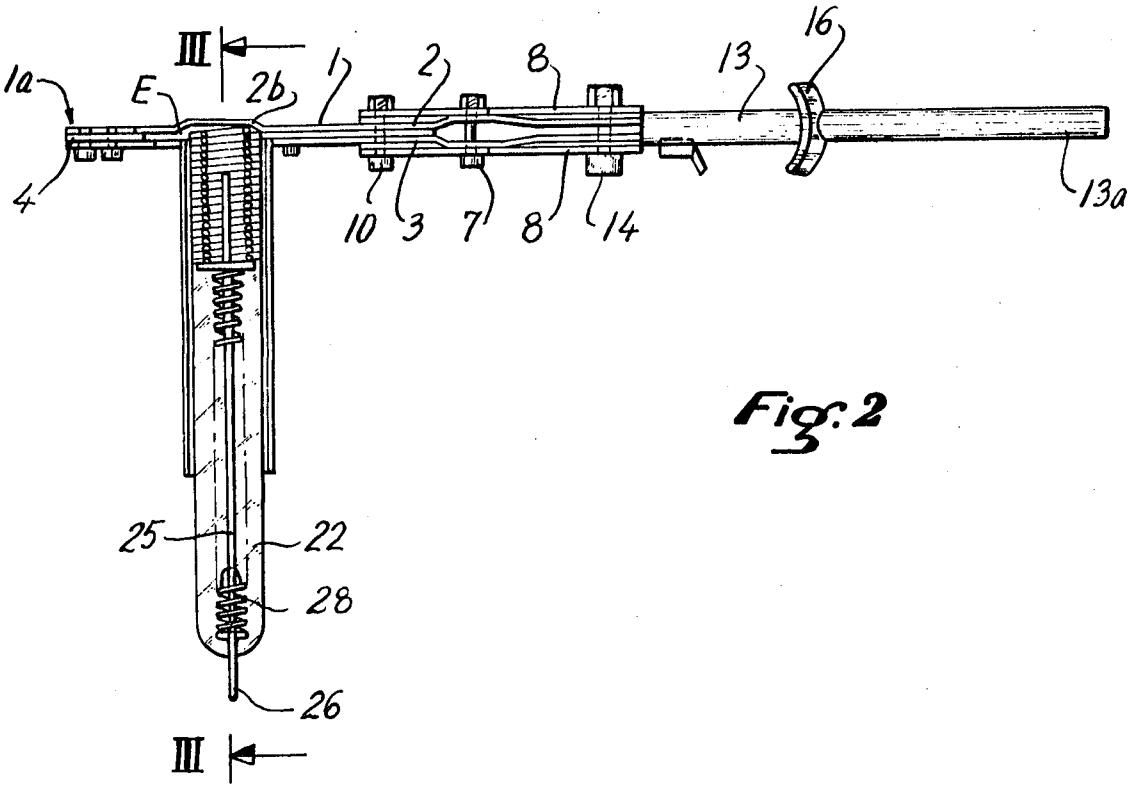
FIG. 2 is a plan view of the pliers of FIG. 1.

Referring now to the drawings in detail, as shown in FIGS. 1 and 2, the pliers substantially comprise a central body 1 formed by two plates 2, 3, between which is provided a free space E. Said free space E is limited at the front portion 1*a* of the pliers by a spacer part 4, which forms an abutment, and at its rear portion by a mobile blade 5 (FIG. 5) having an extension 5*a* which is slidable under the spacer part 4. The thickness of the spacer part 4 is slightly greater than the thickness of the part 5. The rear face 4*a* of the part 4, and the front face 5*b* of the mobile part 5, are recessed so as to provide them with a shape resembling an arc of a circle.

Two openings 6, 6*a* (FIGS. 1 and 5) are provided in the plates 2 and 3, which form the body 1 of the pliers, for enabling passage of a pin 7 which is rigid with the mobile part 5. This pin 7 is used as an articulation point for dual small rods 8, 9 mounted on articulations 10, 11, which are fixed at the ends of two dual arms 12, 13. These two dual arms 12, 13 are pivotally mounted on a pin 14 which is fixed at the rear end of the plier central body 1.

The dual arms 12, 13 have suitably shaped rear portions, which approximate the shapes of the handles of pliers currently used for gripping or cutting metal parts. Thus, the shape of these handles 12*a*, 13*a* make possible a very good grip when the user places the pliers in his hand and, as a result, a movement bringing them together is easy and without any risk. On the handles 12*a*, 13*a* are protection shells 16, 17 in order to avoid squeezing one's fingers and the edge of the palm of the hand when using the pliers.

Figure 5:
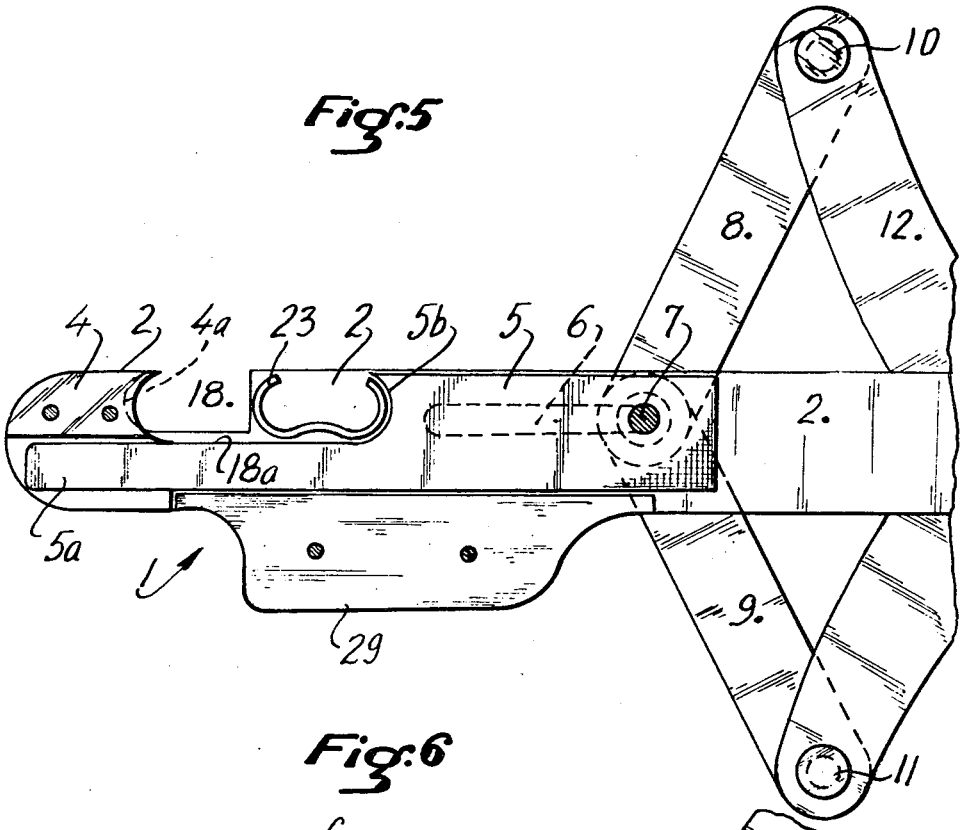
FIG. 5 is an enlarged side elevation view of the front portion of the pliers at the moment when the clip leaves the magazine.
Figure 6:
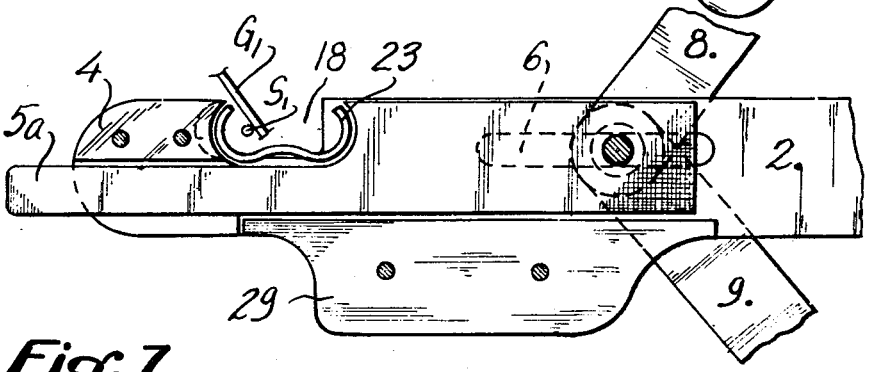
FIG. 6 is a side elevation view of the pliers during operation and when a ring is being formed.
Figure 7:
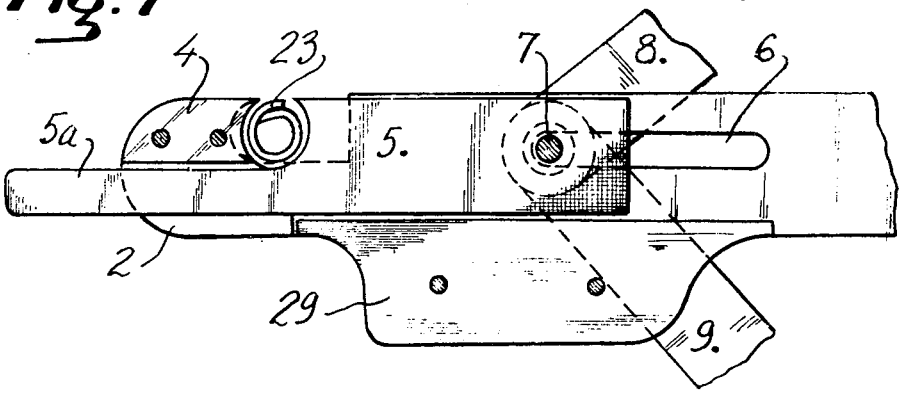
FIG. 7 is a side elevation view of the pliers showing the ring formed when the pliers are completely closed.

As shown in FIG. 1, as well as in FIGS. 5 to 7, the plates 2, 3 are each formed on their upper portion with a recess 18, 18*a*. These recesses are limited at their bottom portion so that they are substantially flush with the upper portion of the extension 5*a* of the mobile part 5. Moreover, the recess 18*a* which is formed in plate 3 is longer than that provided in plate 2 to enable positioning of a magazine 20 (see FIG. 3) supported by an L-shaped support 21 attached to plate 3. This support 21, in turn, supports a U-shaped part 22 forming a supply magazine in which are introduced clips 23 assembled together in an array. The clips 23, which are open towards the top (see FIGS. 5 to 7), are pressed by a mobile part 24 which slides along a rod 25 fixed by its rear hook 26 in a hole 27 that is formed in the bottom of the supply magazine 22.

A spring 28 biases the clip array back towards the opening 18*a* of the plate 3 against plate 2. Under the plates 2, 3 is a reinforced area 29 which provides support for the part 21, which in turn supports the supply magazine 22.

When one operates the handles 12*a*, 13*a* in the direction of the arrows F1, F2 (see FIG. 1), the movement of these handles pivots the plier arms 12, 13, thereby causing displacement of the small rods 8, 9 in the direction of the arrow F3 (FIG. 1). This also displaces the pin 7 in the same direction, thereby pushing out the mobile part 5. Since the supply magazine 20 is placed perpendicular to the central plier body 1, this movement also results in the disconnection of a clip 23, which is then slid towards the front end of the pliers, coming to rest against the arc-shaped side of the recess 18 (FIG. 5). With the clip 23 thus in readiness, the pliers are positioned so that a support wire $S_1$ and a wire netting element $G_1$ (FIG. 6) are also contained in the recess 18. As the pliers are further tightened by displacement of the pin 7 in the openings 6, 6*a* of the central body 1, this forces a complete closing of the clip 23, which then forms a ring (see FIG. 7) around the wires $S_1$, $G_1$. When the ring thus formed is completely closed, one has only to move the plier handles 12, 13 in the opposite direction to the arrows F1, F2 (see FIG. 1). This action may be facilitated by a spring blade suitably placed inside the arms 12, 13 of the pliers. The spring blade would be compressed during the working phase of the pliers and its recoil movement, when the handles are released or allowed to open, would cause a backward movement in the direction opposite to that shown by the arrow F3 (FIG. 1). This would cause the mobile part 5 to resume the position shown in FIG. 5. At this moment, and under pressure of the spring 28, the array of clips 23 is pushed onward and the next clip enters the plier body at the free space E, and is pushed until the moment it comes to bear against the inner wall of plate 2. The pliers are then set and ready for a new operation.

Figure 3:
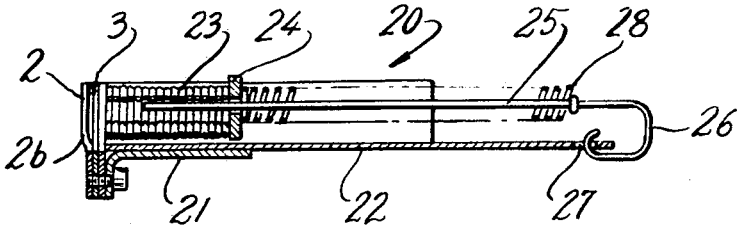
FIG. 3 is a cross-sectional view taken along line III—III of FIG. 2 showing the magazine containing the clips.
Figure 4:
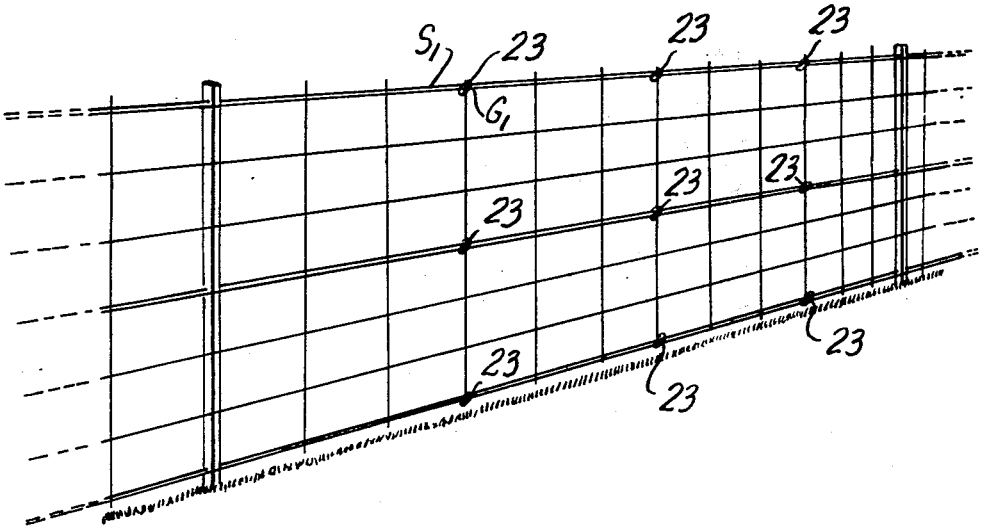
FIG. 4 is a perspective view of a wire netting supported on wires through rings fixed by the pliers.

When the array of clips is completely used, one simply removes the guiding rod 25 of the supply magazine 22, introduces a new array of clips, and puts the guiding rod 25 back in place as shown in FIG. 3. The pliers are then again ready for operation.

To transport the pliers and to avoid occupying too much a space, the pliers are closed in the direction of the arrows F1, F2 after the clips are removed from the supply magazine. The pliers are then locked in a closed position by interposing the security finger 30, which is articulated on a pin 31 that is rigid with the arm 12, behind a catch 32 provided on a portion of the plate 3 of the body 1.

Finally, there is provided in the upper portion of the plate 2 a clearance 2*b* (FIG. 2) which allows an easy extraction of the rings 23 from the plier body.

Figure 8:
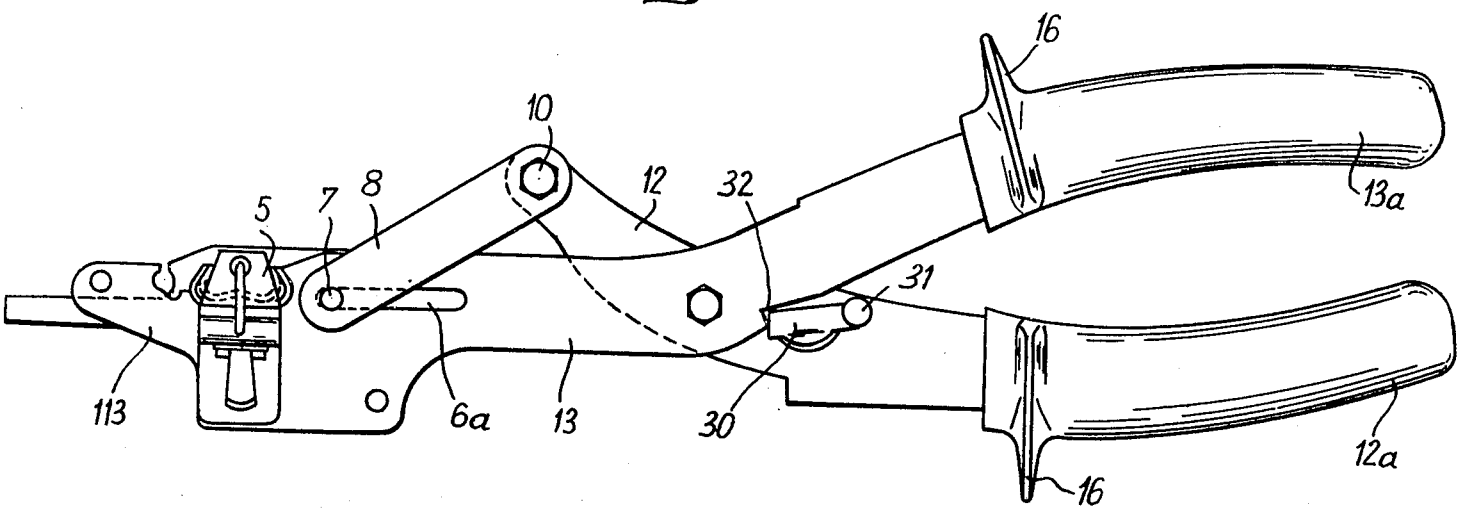
FIGS. 8 and 9 respectively show in elevation and in plan a slightly modified shape of the pliers used for small works, for instance when a wire netting is erected by a non specialist.
Figure 9:
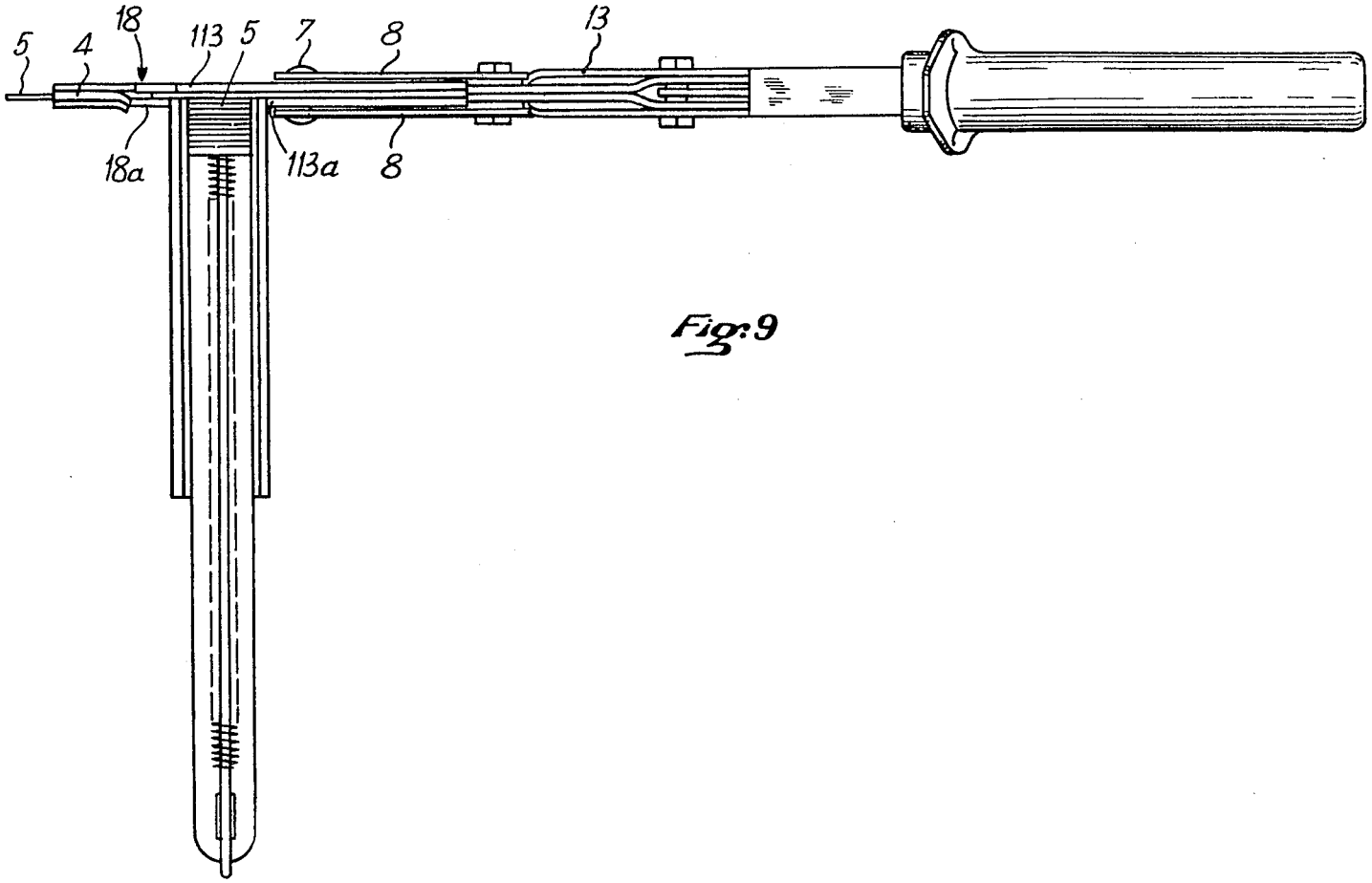

The small pliers shown in FIGS. 8 and 9 comprise elements which are identical to those of the pliers hereabove described. Thus some of the reference numerals are used here again for designating the same parts. The arm 12, which is also dual, carries at its front end the pin 10 and the dual small rods 8, 9 cooperating with the pin 7 for driving the mobile plate 5.

But, in this embodiment, the arm 13 is continued by two blades 113, 113*a* between which slides the mobile blade 5, the blades 113, 113*a* being kept at a constant distance from each other by the spacer part 4.

As in the previous case, the blades 113, 113*a* are cut-out so as to form recesses 18, 18*a*. The recess 18*a* is longer than the recess 18. Moreover, the mobile blade 5 has also an extension 5*a* flush with the bottom portion of the recesses 18, 18*a*. The blade 113*a* of the pliers also has a supply magazine, as in the previous case of FIGS. 1 to 7.

Operation of the pliers of FIGS. 8 and 9 is identical to that hereabove described, but due to their reduced dimensions, they are easier to use by non specialists and are also less costly.

The present invention is, of course, in no way limited to the specific disclosure of the specification and drawings, but also encompasses any modifications within the scope of the appended claims.

What we claim is:

1. A device for positioning clips which form connecting rings between a wire netting and support wires, which comprises:

a first plate and a second plate forming the body of said device, each of said plates being provided with a recess;

a fixed spacer part interposed between a portion of one end of each of said plates;

a mobile part guidable between said plates, said spacer part having substantially the same thickness as said mobile part;

a pin displaceably journalled in said plates and rigidly connected to said mobile part;

actuating means for displacing said pin and guiding said mobile part, said actuating means including two arms pivotally interconnected near a front end thereof closest to said plates, and means for operatively connecting said front ends of said arms to said pin; and a clip supply magazine mountable to said device for providing clips to one of said recesses to enable deformation of a clip between said mobile part and said fixed spacer part.

2. A device according to claim 1 in which said recess which receives a clip is located in said first plate and is larger than said other recess.

3. A device according to claim 1, in which displacement of said pin is limited by slots respectively located in each of said plates.

4. A device according to claim 1, in which said second plate has a recessed conformation located opposite the place where said clip supply magazine is attached to said device for facilitating disengagement of rings formed by said device.

5. A device according to claim 1, in which said means for operatively connecting said front ends of said arms to said pin comprises small rods, one end of each of which is pivotally connected to respective front ends of said arms, and the other end of each of which is pivotally connected to said pin.

6. A device according to claim 1, in which said means for operatively connecting said front ends of said arms to said pin comprises a small rod, one end of which is pivotally connected to said front end of one of said arms, and the other end of which is pivotally connected to said pin, and an extension of said other arm operatively connected to said pin.

7. A device according to claim 6, in which said other arm, said extension of said other arm, and one of said plates are one continuous piece.

* * * * *